US010726648B2

(12) United States Patent
Watanabe et al.

(10) Patent No.: US 10,726,648 B2
(45) Date of Patent: Jul. 28, 2020

(54) ELECTRONIC CONTROL APPARATUS

(71) Applicant: DENSO CORPORATION, Kariya, Aichi-pref. (JP)

(72) Inventors: Jin Watanabe, Kariya (JP); Koji Nagata, Kariya (JP)

(73) Assignee: DENSO CORPORATION, Kariya (JP)

( * ) Notice: Subject to any disclaimer, the term of this patent is extended or adjusted under 35 U.S.C. 154(b) by 300 days.

(21) Appl. No.: 15/872,150

(22) Filed: Jan. 16, 2018

(65) Prior Publication Data

US 2018/0211452 A1 Jul. 26, 2018

(30) Foreign Application Priority Data

Jan. 20, 2017 (JP) ..... 2017-008927
Jan. 10, 2018 (JP) ..... 2018-002001

(51) Int. Cl.
*G07C 5/08* (2006.01)
*G07C 5/10* (2006.01)

(52) U.S. Cl.
CPC ..... *G07C 5/085* (2013.01); *G07C 5/10* (2013.01)

(58) Field of Classification Search
CPC ..... G07C 5/085; G07C 5/10
See application file for complete search history.

(56) References Cited

U.S. PATENT DOCUMENTS

2013/0060418 A1* 3/2013 Nomura ..... G06F 11/0739 701/33.4

FOREIGN PATENT DOCUMENTS

JP 2000-347727 A 12/2000
JP 2004-304418 A 10/2004

* cited by examiner

*Primary Examiner* — Russell Frejd
(74) *Attorney, Agent, or Firm* — Posz Law Group, PLC

(57) ABSTRACT

An electronic control apparatus includes an event portion, a cumulative number acquiring portion, a time series information acquiring portion, and a storing execution portion. The event portion acquires an event information item representing an occurrence of an event. The cumulative number acquiring portion acquires a cumulative number of the occurrence of the event each time the event information item is acquired. The time series information acquiring portion acquires a time series information item each time the event information item is acquired. The storing execution portion stores, corresponding to the cumulative number, the time series information item cumulatively acquired by the time series information acquiring portion using all area of an information storage portion each time the time series information item is acquired. The time series information item includes vehicle information entries arranged in chronological order. Each of the vehicle information entries represents a condition of the vehicle.

5 Claims, 10 Drawing Sheets

FIG. 5

<table>
<tr><th>SETTING OPTIONS</th><th>SETTING CONTENTS</th></tr>
<tr><td>EVENT PRIORITY</td><td>P1 > P2 = P3 > P4</td></tr>
<tr><td>MINIMUM INFO AMOUNT (ENTRY)</td><td>A=2 , B=2<br>C=2 , D=2</td></tr>
<tr><td>OCCURRENCE ORDER PRIORITY</td><td>PRIORITIZE OLDEST EVENT</td></tr>
<tr><td>FREE AREA SETTING INFO</td><td><table><tr><td>CUMULATIVE NUMBER</td><td>1</td><td>2</td><td>3</td><td>4</td></tr><tr><td>AMOUNT OF FREE AREA (ENTRY)</td><td>8</td><td>4</td><td>2</td><td>2</td></tr></table></td></tr>
<tr><td>TIME SERIES SETTING INFO</td><td>SEE FIG. 6</td></tr>
</table>

COMPARISON EXAMPLE

ELECTRONIC CONTROL APPARATUS

CROSS REFERENCE TO RELATED APPLICATION

This application is based on Japanese Patent Application No. 2017-008927 filed on Jan. 20, 2017 and Japanese Patent Application No. 2018-002001 filed on Jan. 10, 2018, the disclosures of which are incorporated herein by reference.

TECHNICAL FIELD

The present disclosure relates to an electronic control apparatus that stores information regarding a vehicle.

BACKGROUND

Conventionally, a control apparatus for a vehicle (i) repeatedly acquires vehicle information representing arbitrary information of a vehicle, such as an output value of a sensor attached to the vehicle, or a control value for an actuator and (ii) stores the vehicle information in a predetermined order according to an elapsed time, that is, in time series.

As disclosed in JP 2013-056589 A (corresponding to US 2013/0060418), when a predetermined event in the vehicle occurs, a control apparatus stores time series vehicle information in a memory.

SUMMARY

Suppose that multiple events occur in a vehicle. In order to store time series vehicle information in detail each time the event occurs, preferably, much storage area is previously assigned to a memory for storing the time series vehicle information. An amount of storage area that is capable of being assigned has a limit. A common solution is that all of the memory area that has predetermined amount is divided equally into a predetermined number of areas, each of which is referred to as an equal area. Then, the time series vehicle information is stored in the equal area each time the event occurs.

When occurrence number of the event is less than a predetermined number, in the memory, there is an area that does not store the time series vehicle information. Thus, the memory cannot be used efficiently by the electronic control apparatus.

In view of the foregoing difficulties, it is an object of the present disclosure to provide an electronic control apparatus that can efficiently use a predetermined amount of the memory area which stores the information related to the vehicle.

According to an aspect of the present disclosure, the electronic control apparatus attached to a vehicle includes an event portion, a cumulative number acquiring portion, a time series information acquiring portion, and a storing execution portion. The event portion acquires an event information item representing an occurrence of an event that is predetermined related to the vehicle. The cumulative number acquiring portion acquires a cumulative number of the occurrence of the event each time the event information item is acquired. The time series information acquiring portion acquires a time series information item each time the event information item is acquired.

The storing execution portion stores, corresponding to the cumulative number, the time series information item cumulatively acquired by the time series information acquiring portion using all area of an information storage portion each time the time series information item is acquired. The information storage portion has a predetermined memory area. The time series information item includes vehicle information entries arranged in chronological order. Each of the vehicle information entries represents a condition of the vehicle.

The electronic control apparatus described above stores the time series information that is acquired in each event occurrence in all area of an information storage portion. The electronic control apparatus can efficiently use all of the memory area in the information storage portion and the memory area does not remain.

BRIEF DESCRIPTION OF THE DRAWINGS

The above and other objects, features and advantages of the present disclosure will become more apparent from the following detailed description made with reference to the accompanying drawings. In the drawings:

FIG. 5 is a diagram showing settings of an event priority, a minimum information amount, an occurrence order priority, free area setting information, and time series setting information;

DETAILED DESCRIPTION

Hereinafter, embodiment of the present disclosure will be described with reference to the drawings.

(Configuration)

Figure 1:
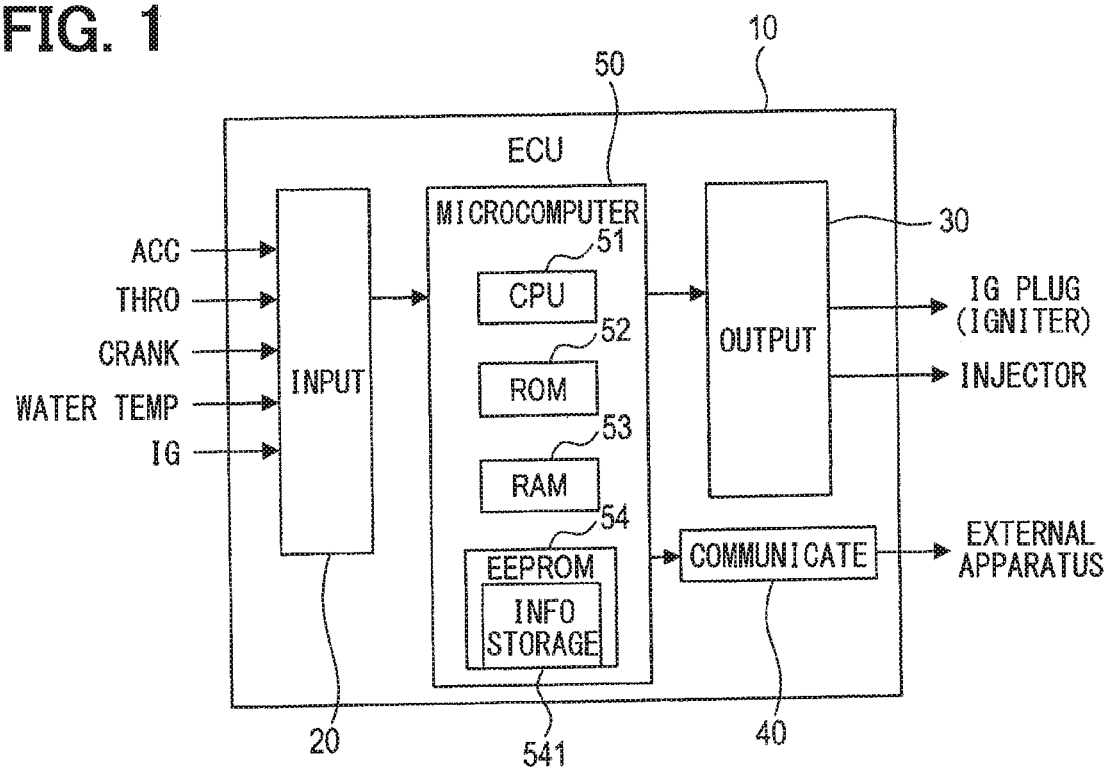
FIG. 1 is a block diagram showing a configuration of ECU according to an embodiment.

An electronic control apparatus 10 shown in FIG. 1 is attached to a vehicle. Hereinafter, the electronic control apparatus 10 referred to as an Electronic Control Unit (ECU) 10. The ECU 10 may be an engine ECU that controls injection of an injector or ignition by an ignition plug (IG PLUG).

The ECU 10 includes an input circuit (INPUT) 20, an output circuit (OUTPUT) 30, a communication circuit (COMMUNICATE) 40, and a microcomputer 50. The microcomputer 50 has a CPU 51 and a semiconductor memory, such as a ROM 52, a RAM 53, or an EEPROM 54.

The CPU 51 executes corresponding program that is stored in a non-transitory tangible storage medium so that each of the various kinds of functions of the ECU 10 is achieved. In the present embodiment, the ROM 52 corresponds to the non-transitory tangible storage medium that stores the program. Method corresponding to the program is implemented by execution of the program. In the present embodiment, a quantity of the microcomputer included in the ECU 10 is one. Alternatively, a quantity of microcomputers included in the ECU 10 may be plural.

The RAM 53 is a memory employed in the execution of the program. The EEPROM 54 is a rewritable and non-volatility memory. Even though power supply from a battery, which is not shown in FIG. 1, is shut off, data can be maintained in the EEPROM 54.

Figure 2:
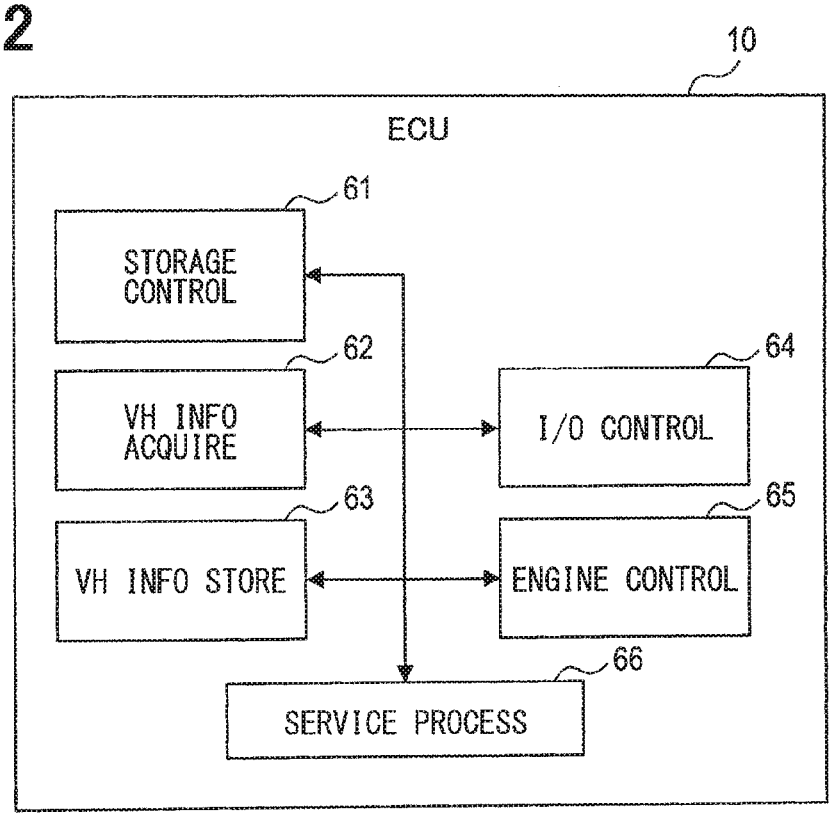
FIG. 2 is a block diagram showing functions of the ECU.

As shown in FIG. 2, the ECU 10 includes a storage control portion (STORAGE CONTROL) 61, a vehicle information acquirement portion (VH INFO ACQUIRE) 62, a vehicle information storage portion (VH INFO STORE) 63, an input/output control portion (I/O CONTROL) 64, an engine control portion (ENGINE CONTROL) 65, and a service processing portion (SERVICE PROCESS) 66. With this configuration, the CPU 51 achieves the functions of the ECU 10 by executing the program.

Manner to achieve the components that configure the ECU 10 is not limited to software. A piece of or multiple pieces of hardware may achieve a part of or all components. Suppose that an electronic circuit that is hardware may achieve functions. In this case, the electronic circuit may be provided by a digital circuit that includes multiple logic circuits, an analog circuit, or a combination of the digital circuit and the analog circuit.

The ECU 10 acquires vehicle information through the input circuit 20. The vehicle information is a signal that represents a vehicle condition input through the input circuit 20 from various kinds of sensors, various kinds of switches, or the like. In the present embodiment, the vehicle information may be input as an accelerator opening level (ACC), a throttle opening level (THRO), a crank angle (CRANK), an engine water temperature (WATER TEMP), or an ignition switch signal (IG). The vehicle information is not limited to examples described above. The vehicle information may include an arbitrary control amount employed in vehicle control, such as a command injection amount for the injector, or an ignition time for the ignition plug.

The ECU 10 outputs, through the output circuit 30, an injector drive output that drives the injector, an igniter drive output that controls the ignition of the ignition plug, and the like each of which is generated by the engine control portion based on the vehicle information.

The ECU 10 generates the injector drive output, the igniter drive output, and the like based on vehicle information input through the input circuit 20.

The ECU 10 outputs time series information stored in the EEPROM 54 to an external apparatus through the communication circuit 40. The time series information will be described below.

The ECU 10 detects occurrence of a predetermined event regarding the vehicle, and then outputs event information. The event information represents the occurrence of predetermined events related to the vehicle.

The events include predetermined vehicle operations, such as an engine stall, an engine start failure, an abnormality of engine water temperature, or a condition that the accelerator opening level is equal to or greater than a threshold level. The engine stall represents an engine stopping during a travel of the vehicle. The engine start failure represents that the engine is incapable of rotating when the engine starts.

The abnormality of engine water temperature may be defined as a state in which the engine water temperature is equal to or higher than a predetermined upper limit, or the abnormality of engine water temperature may be defined as a state in which the engine water temperature is lower than a predetermined lower limit. The engine water temperature, which is equal to or higher than the upper limit or lower than the lower limit, represents that an abnormality may occur in the engine. The state that the accelerator opening level is equal to or greater than a threshold level represents that an electric throttle fails to open even though a gas pedal is depressed by a driver.

The events may include the vehicle operations that satisfy corresponding predetermined conditions. The events are not limited to vehicle abnormalities, and may include an arbitrary operation of the vehicle. The vehicle abnormality represents an abnormal operation that does not occur in a normal drive operation.

The ECU 10 may detect events, such as an arbitrary detection value of the sensor, or an arbitrary condition of the actuator other than the operation of the vehicle described above. The number of events detected by the ECU 10 may be set to plural. Priority may be previously set to each of the events detected by the ECU 10.

In the present embodiment, the ECU 10 detects four events including the engine stall, the engine start failure, the abnormality of engine water temperature, and the condition that the accelerator opening level is equal to or greater than the threshold level. Hereinafter, the engine stall is defined as a first event, the engine start failure is defined as a second event, the abnormality of engine water temperature is defined as a third event, and the condition that the accelerator opening level is equal to or greater than the threshold level is defined as a fourth event. Each of the events which is detected by the ECU 10 is previously stored in the ROM 52.

As shown in FIG. 5, the priority of each of the events satisfies the following relation. Priority P1 of first event is higher than priority P2 of second event. Priority P2 of second event is equal to priority P3 of third event. Priority P3 of third event is higher than priority P4 of fourth event. That is, P1>P2=P3>P4. The first event has the highest priority. The priority of the events is previously stored in the ROM 52. The priority of the events is referred to as an event priority.

The ECU 10 acquires the vehicle information at regular intervals, such as 50 msec, and then stores the vehicle information in the RAM 53. Data length of the vehicle information may be previously set as an arbitrary length, such as two bytes.

Each vehicle information acquired at regular intervals may be defined as one entry. The ECU 10 stores each eight entries of the time series vehicle information in the RAM 53 in ring buffer format. The time series information represents the vehicle information arranged in chronological order.

When the event occurs, the ECU 10 (*i*) generates the eight-entry time series information in a predetermined manner corresponding to the event types based on time series setting information, and (ii) stores the generated eight-entry time series information in the RAM 53 with event type information. The event type information represents a type of the event that occurs. Each time the event occurs, the ECU 10 increments a cumulative number and stores the cumulative number in the EEPROM 54. The cumulative number is a value that represents a total number of times that the events have occurred by now regardless of the event types.

The time series setting information defines a manner to generate the time series information, and is previously stored in the ROM 52.

Figure 6:
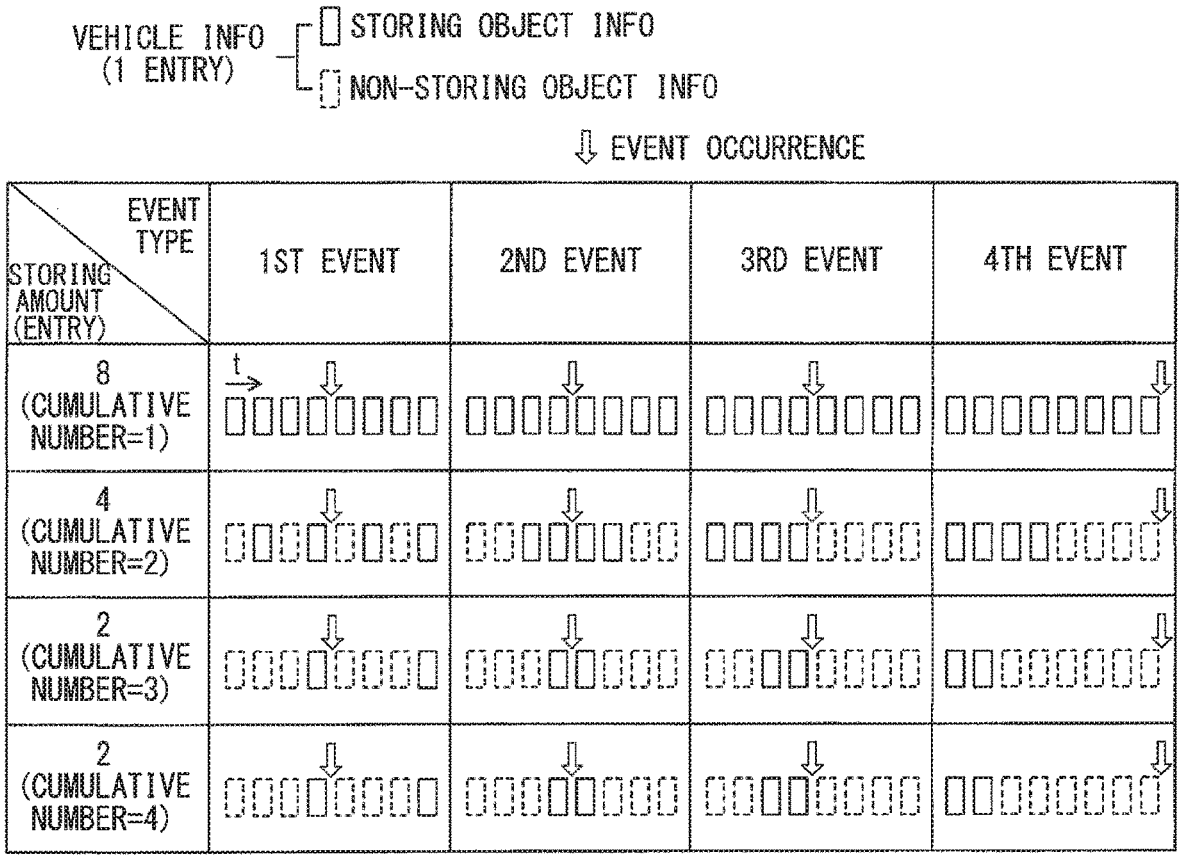
FIG. 6 is a diagram showing time series setting information.
Figure 7:
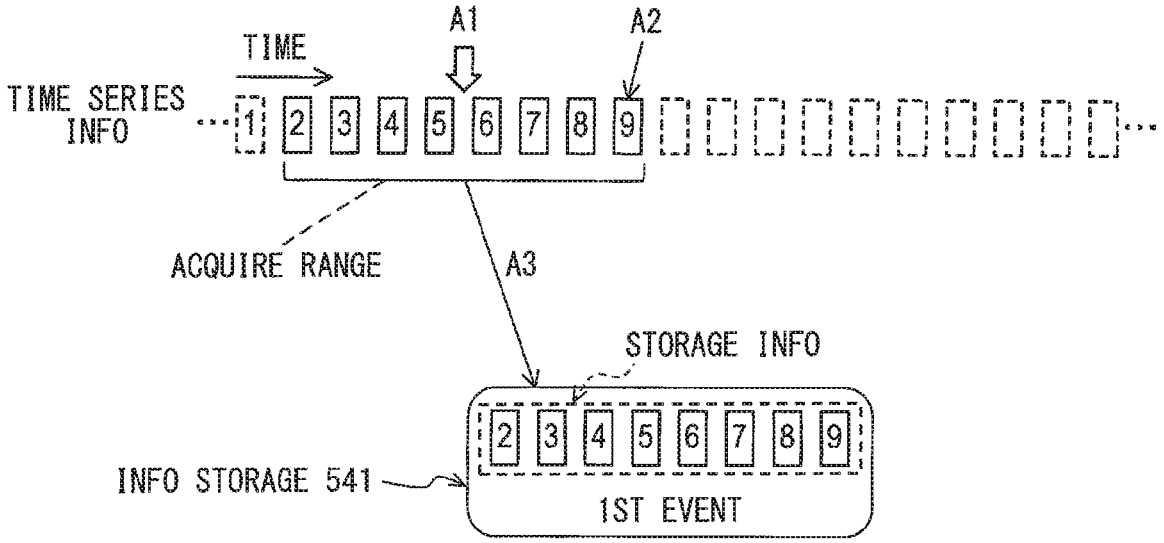
FIG. 7 is a diagram showing an operation in case that a first event occurs firstly in chronological order.
Figure 8:
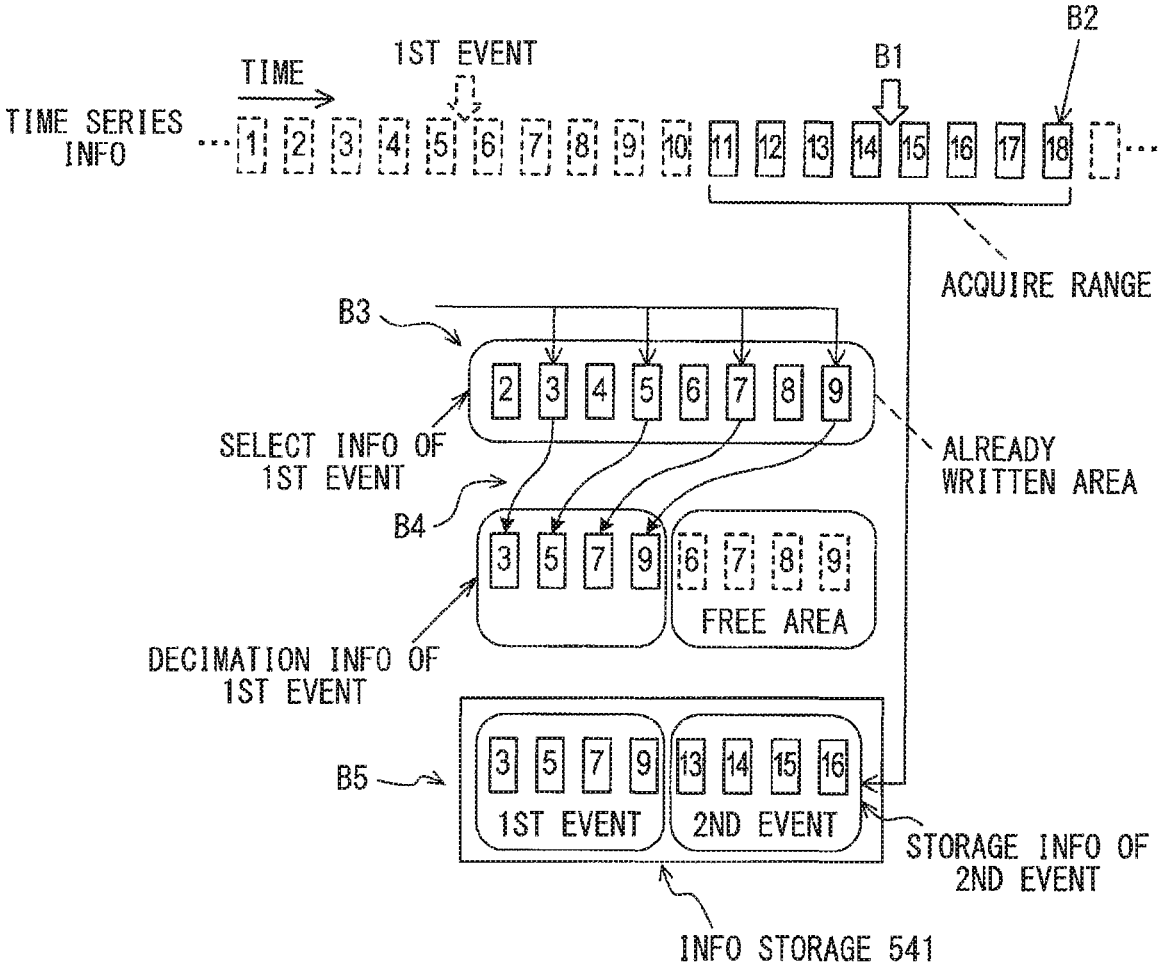
FIG. 8 is a diagram showing an operation in case that a second event occurs secondly in chronological order.
Figure 9:
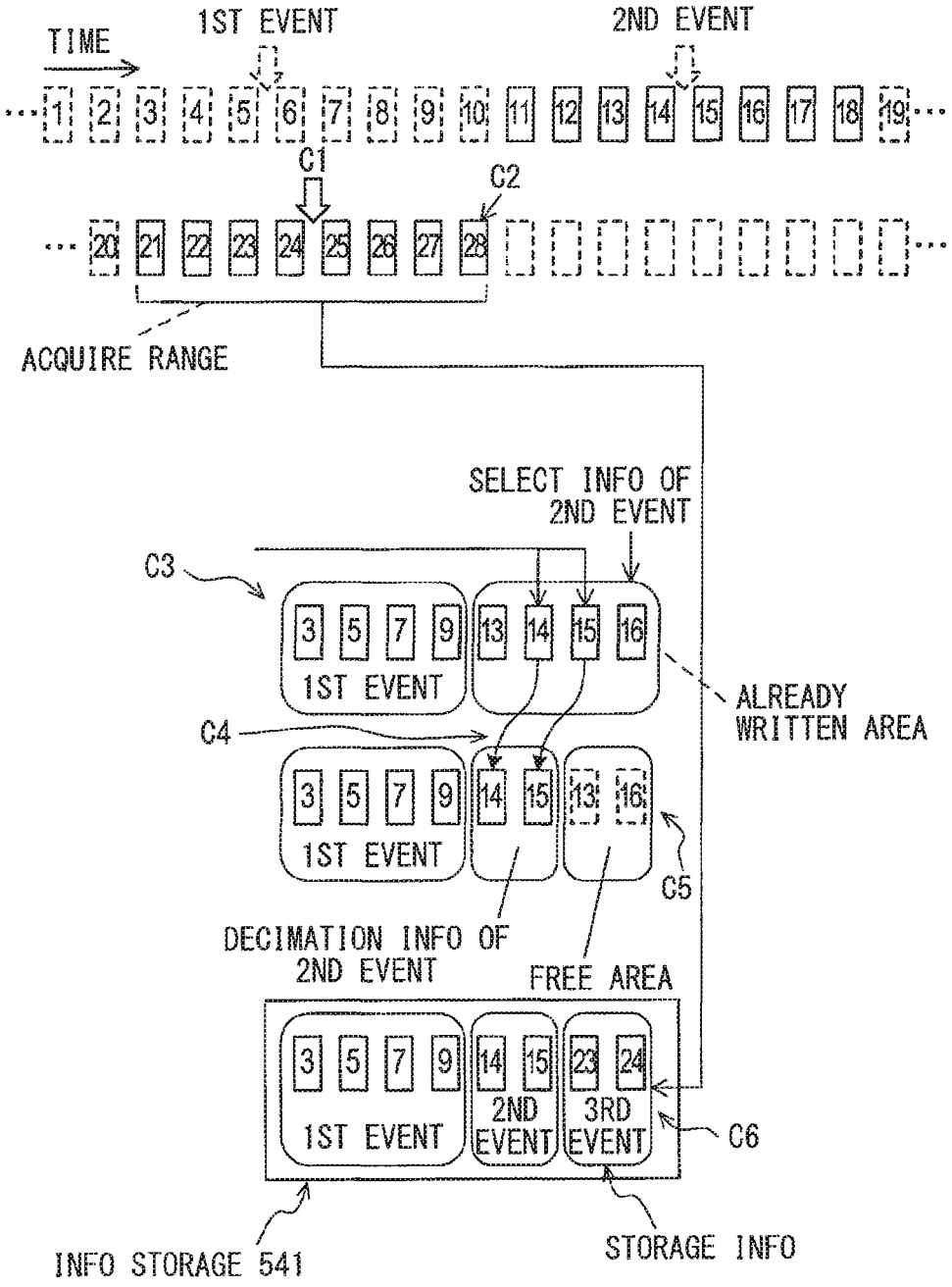
FIG. 9 is a diagram showing an operation in case that a third event occurs thirdly in chronological order.
Figure 10:
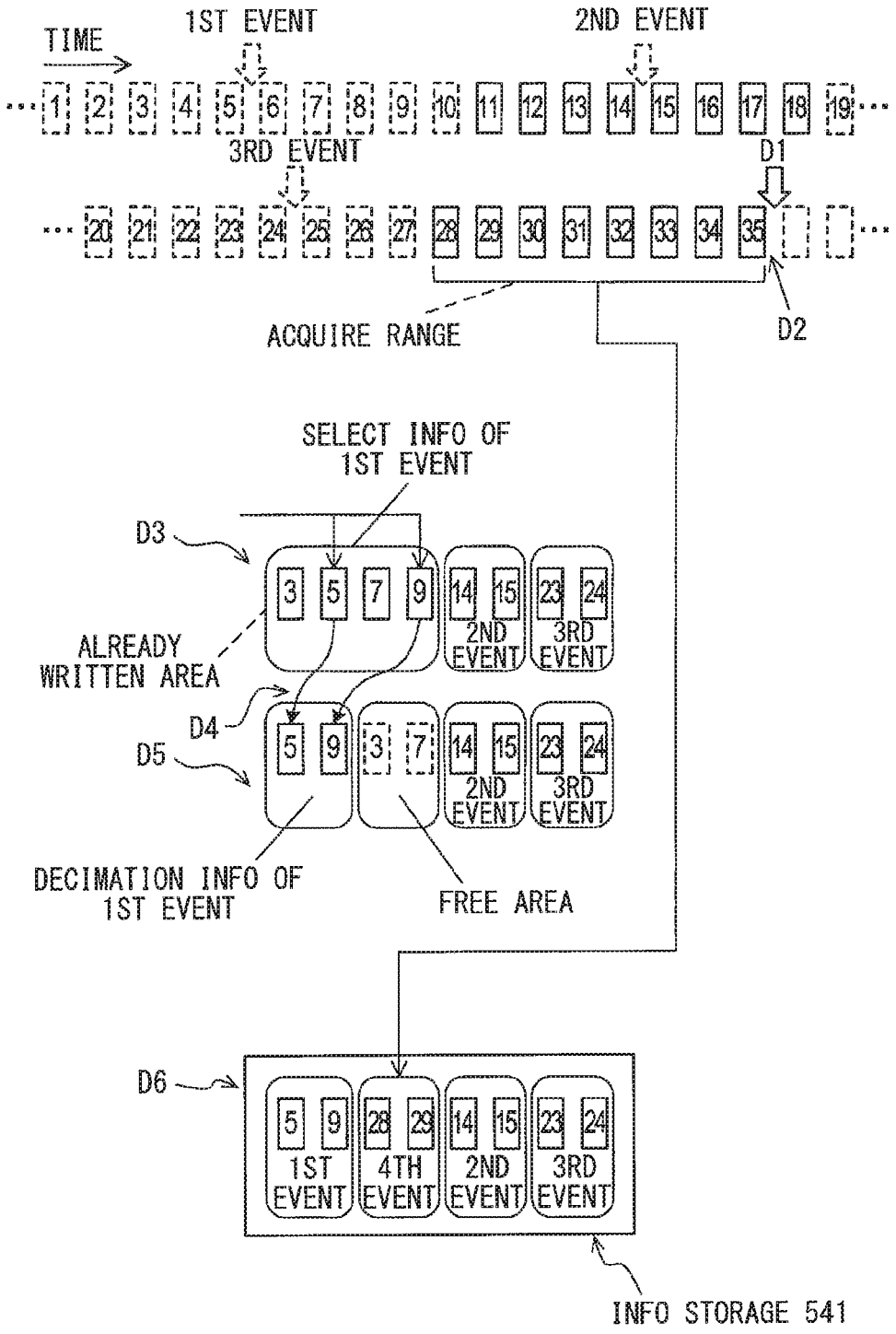
FIG. 10 is a diagram showing an operation in case that a fourth event occurs fourthly in chronological order.

In the present embodiment, the ECU 10 may generate the eight-entry time series information corresponding to the event type based on the time series setting information shown in FIG. 6, and then stores the eight-entry time series information in the RAM 53. When the ECU 10 generates the eight-entry time series information, setting that corresponds to the cumulative number of one is employed. Storage information that will be described below is generated based on the eight-entry time series information.

When the first event occurs, the ECU 10 stores eight-entry vehicle information as the time series information in the RAM 53 based on the time series setting information shown in FIG. 6. The eight-entry vehicle information includes the four-entry vehicle information before event occurrence and the four-entry vehicle information after the event occurrence.

The ECU 10 generates the time series information so that each entry included in the eight-entry vehicle information includes the event type information.

The CPU 51 executes information storing processing so that the ECU 10 stores the time series information that is acquired in each event occurrence in all area of an information storage portion (INFO STORAGE) 541. The time series information is stored according to the cumulative number. The information storage portion 541 is a storage area that is provided in the EEPROM 54 and has a predetermined size.

In the present embodiment, size of the information storage portion 541 is same as the data size of the time series information acquired by the vehicle information acquirement portion 62. That is, the size of the information storage portion 541 corresponds to a storage area that is capable of storing the eight-entry vehicle information.

(Processing)

Figure 3:
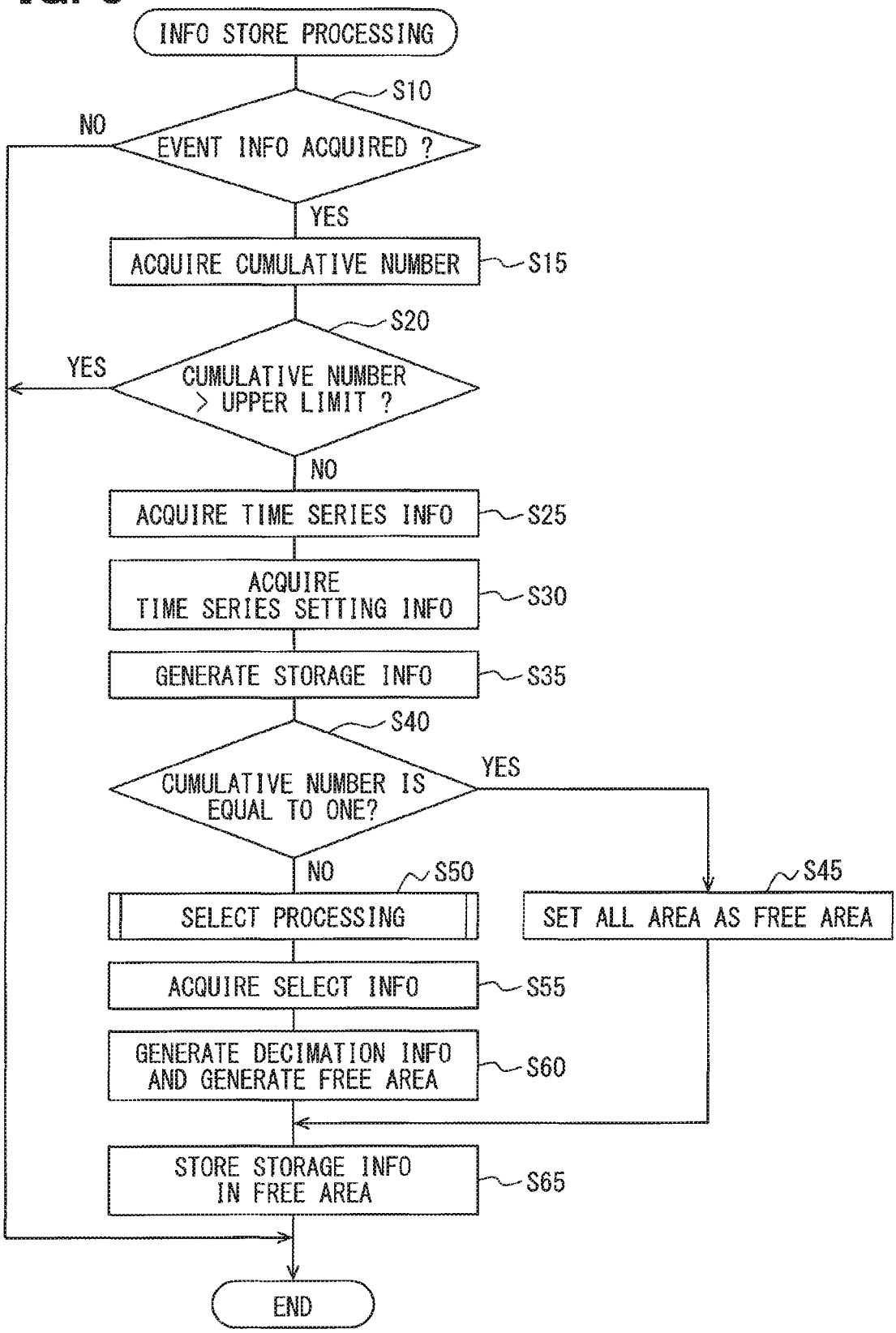
FIG. 3 is a flowchart showing information storing processing.

The information storing processing executed by the vehicle information storage portion 63 of the ECU 10 will be described with reference to FIG. 3. While the ignition switch signal indicates that the ignition switch is in on state, the information storing processing is repeatedly executed in each predetermined period.

In S10, the ECU 10 determines whether the event occurs. Specifically, when acquiring the event information based on the event information output from the storage control portion 61, the ECU 10 determines that the event occurs. When the event occurs (S10: YES), the ECU 10 shifts to S15. When the event does not occur (S10: NO), the ECU 10 ends the information storing processing.

In S15, the ECU 10 requires acquires the cumulative number that is counted by the vehicle information acquirement portion 62.

In S20, the ECU 10 determines whether the cumulative number is more than a predetermined cumulative upper limit. The cumulative upper limit is set to a supposed maximum number of the event occurrence. In the present embodiment, the cumulative upper limit is set to four, and previously stored in the ROM 52. When the cumulative number is equal to or less than the cumulative upper limit (S20: NO), the ECU 10 shifts to S25. When the cumulative number is more than the cumulative upper limit (S20: YES), the ECU 10 ends the information storing processing.

That is, when the cumulative number is more than the cumulative upper limit, the ECU 10 does not store the time series information that will be executed after S25.

In S25, the ECU 10 controls the vehicle information acquirement portion 62 to acquire the eight-entry time series information stored in the RAM 53. As described above, each entry of the vehicle information that configures the eight-entry time series information includes the event type information.

In S30, the ECU 10 acquires the time series setting information stored in the ROM 52.

In S35, the ECU 10 generates the storage information (STORAGE INFO) using the eight-entry time series information that is newly acquired in S25 based on the time series setting information acquired in S30. The storage information is generated based on the eight-entry time series information that is newly acquired corresponding to the event occurrence in S25, and has a data size that corresponds to a size of a free area, which will be described below.

The ECU 10 generates the storage information by decimating one entry or multiple entries of vehicle information from the eight-entry time series information newly acquired in S25 corresponding to the event type and the cumulative number each of which triggers acquisition of the time series information. In the disclosure, to decimate means to delete. The ECU 10 stores the generated storage information in the RAM 53.

In the time series setting information shown in FIG. 6, multiple entries of the vehicle information configure the time series information. In the multiple entries of vehicle information shown in FIG. 6: solid line represents storing object information that needs to be stored; and dashed line represents non-storing object information that needs to be decimated.

When the second event occurs and the cumulative number is one, the ECU stores, in the RAM 53, the eight-entry vehicle information newly acquired in S25 as the storage information based on the time series setting information shown in FIG. 6 without processing the information.

When the second event occurs and the cumulative number is incremented to two, the ECU 10 stores four-entry vehicle information as the storage information in the RAM 53 based on the time series setting information shown in FIG. 6. The four-entry vehicle information is generated to include two-entry vehicle information of the eight-entry vehicle information before the event occurrence and two-entry vehicle information of the eight-entry vehicle information after the event occurrence.

In S40, the ECU 10 determines whether the cumulative number is one. When the cumulative number is one, the ECU 10 shifts to S45. When the cumulative number is equal to or more than two, the ECU 10 shifts to S50.

In S45, the ECU 10 sets all area of the information storage portion 541 as the free area. In the following S65, the ECU 10 stores the storage information generated in S35 in the free area set in S45. Then, the ECU 10 ends the information storing processing.

With the above-described configuration, when the cumulative number is one, the eight-entry vehicle information is generated as the storage information without decimation. Since the information storage portion 541 has a memory area with a size equivalent to a data size of the eight-entry vehicle information, the storage information that represents the time series vehicle information is stored in all area of the information storage portion 541.

In S50 to S65, the ECU 10 stores the multiple pieces of time series information that have been acquired by now in all area of the information storage portion 541 corresponding to the cumulative number.

In S50, the ECU 10 executes select processing that will be described below. The select processing selects one of the multiple pieces of time series information that has been stored in the information storage portion 541.

In S55, the ECU 10 acquires select information. The select information is one of the multiple pieces of the time series information that is selected in select processing S50.

In S60, the ECU 10 generates the free area in an already written area of the information storage portion 541. The select information is stored in the already written area of the information storage portion 541. The amount of the free area generated by the ECU 10 is predetermined by free area setting information. As shown in FIG. 5, the free area setting information may set the size of the free area corresponding to the cumulative number, and is previously stored in the ROM 52. In the present embodiment, when the cumulative number is one, the amount of the free area is set to eight entries. When the cumulative number is two, the amount of the free area is set to four entries. When the cumulative number is three, the amount of the free area is set to two entries. When the cumulative number is four, the amount of the free area is set to two entries.

In S60, the ECU 10 generates the decimation information first. The decimation information is generated by deleting at least one entry of the vehicle information from the select information. The ECU 10 generates the decimation information by decimating the vehicle information that has the same size as the free area from the select information. The free area is set based on the free area setting information. That is, the decimation information is generated corresponding to the event type and the cumulative number.

The ECU 10 stores the decimation information, as new time series information, in a part of the already written area. As described above, the already written area of the information storage portion 541 stores the select information selected previously. The already written area has a larger size than a size of the memory area that is needed to store the decimation information. Thus, the free area is generated after the decimation information is written. The free area represents a remaining area after the decimation information is written in the already written area.

With above-described configuration, the ECU 10 generates the free area in the already written area.

In S65, the ECU 10 stores the storage information generated in S35 in the free area generated in S60. Then, the ECU 10 ends the information storing processing.

Figure 4:
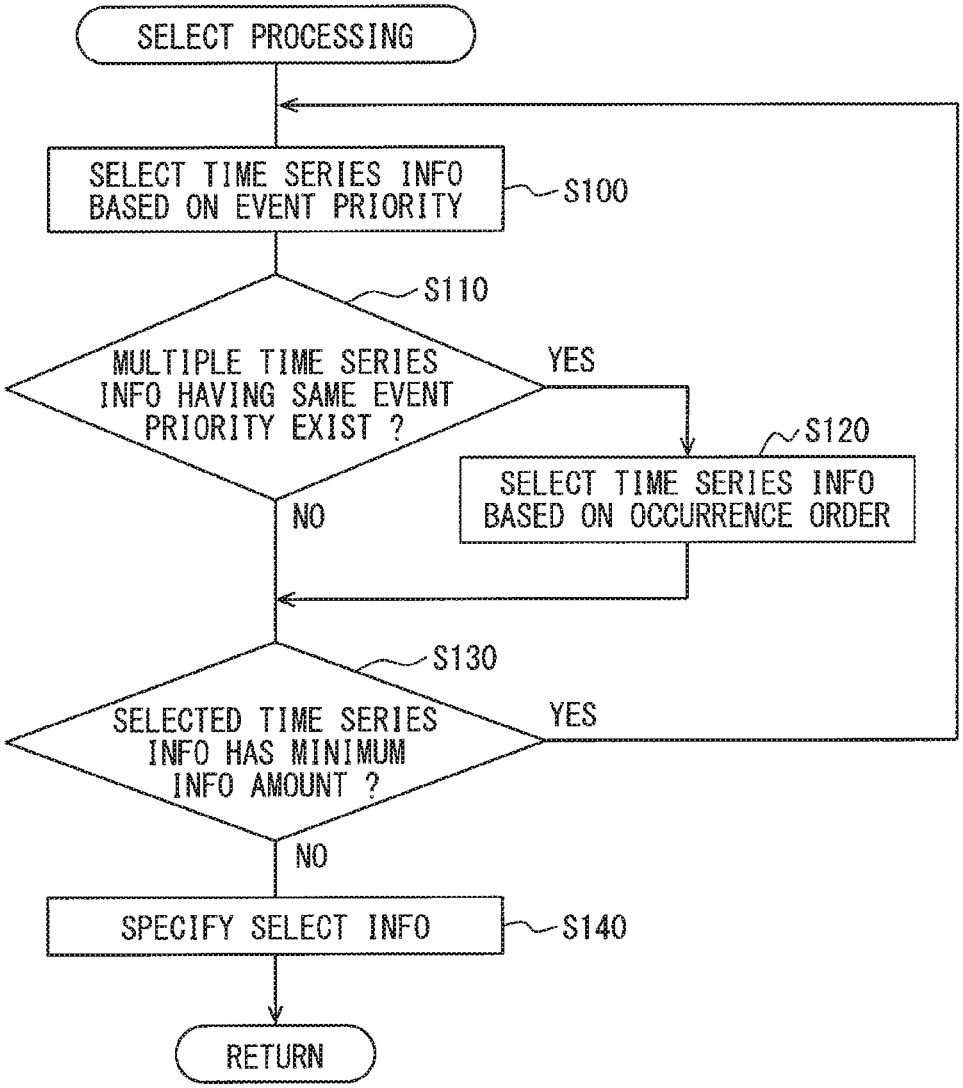
FIG. 4 is a flowchart showing select processing.

The select processing that is executed in S50 of the information storing processing will be described with reference to the flowchart in FIG. 4.

In S100, the ECU 10 acquires an event priority from the ROM 52. The ECU selects one or more pieces of the multiple pieces of time series information that have been stored in the information storage portion 541 corresponding to the event priority that triggers the acquisition of the corresponding time series information. Specifically, the ECU 10 selects one or more pieces of time series information that have the lowest event priority among all pieces of the time series information.

In S110, the ECU 100 determines whether the time series information that has the same, for example, the lowest events priority and is selected in S100 is plural. The time series information that has the lowest events priority is selected from the multiple time series information that has been stored in the information storage portion 541. When multiple pieces of time series information that have the lowest event priority are selected in S100 (S110: YES), the ECU 10 shifts to S120. When only one piece of time series information that has the lowest event priority is selected in S100 (S110: NO), the ECU 10 shifts to S130.

In S120, the ECU 10 selects one of the multiple pieces of the time series information that have the lowest priority corresponding to an occurrence order of the events which trigger the acquisition of the multiple pieces of time series information. Occurrence order setting information sets a high priority to the event that has the oldest occurrence order, and is previously stored in the ROM 52. The ECU 10 selects the event that has the oldest occurrence order as a priority based on the occurrence order setting information.

With the above-described configuration, when, in S100, multiple pieces of the time series information that have the lowest event priority are selected from the multiple pieces of time series information that have been stored in the information storage portion 541, only one piece of the time series information is selected based on the occurrence order in S120.

In S130, the ECU 10 determines whether the data amount of one piece of time series information selected in S100 to S120 is a minimum information amount. The minimum information amount is a minimum information amount of each piece of time series information that is to be stored in the information storage portion 541.

The minimum information amount may be set to a different value corresponding to the type of the event that triggers a storing of the time series information. The minimum information amount may be set to a same value regardless of the event type that represents the trigger in which the time series information is stored. In the present embodiment, as shown in FIG. 5, the minimum information amount is set to the same value of two entries.

The minimum information amount is obtained by dividing all of the memory area of the information storage portion 541 by the cumulative upper limit. The minimum information amount is previously stored in the ROM 52.

When the information amount of the one piece of time series information that is selected is greater than the minimum information amount (S130: NO), the ECU 10 shifts to S140. In S140, the ECU 10 specifies one piece of the time series information that is selected as the select information, and stores the select information in the RAM 53. Then, the ECU 10 ends the select processing.

When the information amount of the one piece of time series information is equal to the minimum information amount (S130: YES), the ECU 10 shifts to S100, and then executes the select processing in S100 to S130 again. That is, the ECU selects the time series information again.

As described above, the ECU 10 generates the decimation information in S60 based on the time series information that is specified as the select information in the select processing. When the time series information selected in S110 or S120 has the minimum information amount, in S130, the ECU 10 selects the time series information again so that the information amount of the time series information stored in the information storage portion 541 is equal to or greater than the minimum information amount.

(Operation)

Operation of the ECU 10 that has the above-described configuration will be described with reference to FIG. 7 to FIG. 10.

The case that a first event occurs firstly in chronological order will be described. As shown by symbol A1 in FIG. 7, suppose that the first event occurs. As shown by symbol A2, after acquiring vehicle information entry 9 based on the time series setting information, the vehicle information acquirement portion 62 generates the eight-entry vehicle information as one piece of the time series information and stores the time series information in the RAM 53. The eight-entry vehicle information includes vehicle information entry 2 to vehicle information entry 9. Four vehicle information entries 2 to 5 are before the first event, and four vehicle information entries 6 to 9 are after the first event.

As shown by symbol A3, since the cumulative number is one when the first event occurs firstly in chronological order, the vehicle information storage portion 63 sets the eight-entry vehicle information as the storage information based on the time series setting information. The vehicle information storage portion 63 sets the free area to have a memory size equal to a data size of eight-entry vehicle information. That is, the vehicle information storage portion 63 sets all area of the information storage portion 541 as the free area. The vehicle information storage portion 63 stores the eight-entry time series information as the storage information that is acquired in response to the occurrence of first event in all area of the information storage portion 541 without processing the storage information.

With the above-described configuration, the storage information that represents the time series information is stored in all area of the information storage portion 541, and the memory area does not remain.

The case that a second event occurs secondly in chronological order will be described. As shown by symbol B1 of FIG. 8, suppose that the second event occurs. As shown by symbol B2, after acquiring the vehicle information entry 18 based on the time series setting information, the vehicle information acquirement portion 62 generates the eight-entry vehicle information as the time series information and stores the time series information in the RAM 53. The eight-entry vehicle information includes vehicle information entries 11 to 18, the vehicle information entries 11 to 14 are before the second event, and the vehicle information entries 15 to 18 are after the second event.

As shown by symbol B3, vehicle information entries 2 to 9 stored as the time series information by the vehicle information storage portion 63 in the information storage portion 541 is specified as the select information.

As shown by symbol B4, the vehicle information storage portion 63 generates the decimation information from the select information based on the free area setting information and the time series setting information. At the same time, the vehicle information storage portion 63 generates the free area to have a memory size equal to a data size of four entries of vehicle information.

In FIG. 6, the memory size of the free area to be generated is defined by the cumulative number which has a value of two. The vehicle information storage portion 63 generates the decimation information by including vehicle information entries 3, 5, 7, and 9. The vehicle information entries to be included in the decimation information is selected in alternative manner from the vehicle information entries 2 to 9 that are acquired in response to the first event. The generation of the decimation information is performed based on the time series setting information corresponding to the first event related to the cumulative number of two shown in FIG. 6. The vehicle information storage portion 63 newly stores the decimation information as the time series information in the already written area, and then generates the free area that has a size equal to a data size of four-entry vehicle information.

As shown by symbol B5, the vehicle information storage portion 63 generates the storage information from vehicle information entries 11 to 18 based on the time series setting information. Specifically, the ECU 10 generates four-entry vehicle information including vehicle information entries 13, 14, 15, and 16 as the storage information by decimating other data from the acquired vehicle information entries 11 to 18. The four-entry vehicle information generated as the storage information includes two-entry vehicle information 13 and 14 before the second event and two-entry vehicle information 15 and 16 after the second event. The eight-entry vehicle information 11 to 18 is acquired in response to the second event. The generation of the storage information is performed based on the time series setting information corresponding to the second event related to the cumulative number of two shown in FIG. 6, and then, the ECU 10 stores the generated storage information in the free area.

In the information storage portion 541, the time series information that is newly acquired is stored in addition to the time series information that has been stored, and the memory area does not remain. The two pieces of time series information include the already stored time series information and the newly acquired time series information. The already stored time series information includes vehicle information entries 3, 5, 7, and 9 acquired in response to the first event. The newly stored time series information includes vehicle information entries 13, 14, 15, and 16 acquired in response to the second event.

The case that a third event occurs thirdly in chronological order will be described. As shown by symbol C1 in FIG. 9, suppose that the third event occurs. As shown by symbol C2, after acquiring vehicle information entry 28 based on the time series setting information, the vehicle information acquirement portion 62 stores the eight-entry vehicle information as the time series information in the RAM 53. The eight-entry vehicle information includes vehicle information entries 21 to 28. Four vehicle information entries 21 to 24 are before the third event, and four vehicle information entries 25 to 28 are after the third event.

As shown by symbol C3, the vehicle information storage portion 63 specifies, as the select information, the vehicle information entries 13, 14, 15, and 16 that are acquired in response to the second event and have the lowest event priority from all of the vehicle information entries 3, 5, 7, 9, 13, 14, 15, and 16 that have already been stored in the information storage portion 541.

As shown by symbol C4, the vehicle information storage portion 63 generates the decimation information from the select information based on the free area setting information and the time series setting information. That is, the vehicle information storage portion 63 generates the free area that has a memory size equal to a data size of two vehicle information entries. The generation of the decimation information is performed based on the time series setting information corresponding to the second event related to the cumulative number of three shown in FIG. 6. The vehicle information storage portion 63 generates the decimation information to include the vehicle information entries 14 and 15 by decimating other vehicle information entries. Specifically, based on the time series setting information corresponding to the second event related to the cumulative number of three shown in FIG. 6, the vehicle information storage portion 63 selects one vehicle information entry 14 before the second event and one vehicle information 15 after the second event from the vehicle information entries 13, 14, 15, and 16 that are acquired in response to the second event. As shown by symbol C5, the vehicle information storage portion 63 newly stores the decimation information of the second event as one piece of time series information in the already written area, and then generates the free area to have a memory size equal to a data size of two vehicle information entries.

As shown by symbol C6, the vehicle information storage portion 63 generates the storage information from the vehicle information entries 21 to 28 acquired in response to the third event based on the time series setting information. The vehicle information storage portion 63 generates the storage information to include the vehicle information entries 23 and 24 by decimating other vehicle information entries. Specifically, the vehicle information storage portion 63 generates the storage information to include the vehicle information entry 23 before the third event and the vehicle information entry 24 after the third event based on the time series setting information corresponding to the third event related to the cumulative number of three shown in FIG. 6. The vehicle information storage portion 63 stores the generated storage information in the free area.

In the information storage portion 541, the one piece of time series information that is newly acquired is stored in addition to the already stored two pieces of time series information, and the memory area does not remain. The three pieces of time series information includes one piece of time series information that has vehicle information entries 3, 5, 7, and 9 acquired in response to the first event, one piece of time series information that has vehicle information entries 14 and 15 acquired in response to the second event, and one piece of time series information that has vehicle information entries 23 and 24 acquired in response to the third event.

The case that a fourth event occurs fourthly in chronological order will be described. As shown by symbol D1 in FIG. 10, suppose that the fourth event occurs. As shown by symbol D2, after acquiring the vehicle information entry 35 based on the time series setting information, the vehicle information acquirement portion 62 stores the eight-entry vehicle information as the time series information in the RAM 53. The eight-entry vehicle information includes vehicle information entries 28 to 35. Four vehicle information entries 28 to 31 are before the fourth event, and four vehicle information entries 32 to 35 are after the fourth event.

As shown by symbol D3, the vehicle information storage portion 63 specifies the vehicle information entries 3, 5, 7, and 9 as the select information from the vehicle information entries 3, 5, 7, 9, 14, 15, 23 and 24 which have already been stored in the information storage portion 541.

When specifying the select information, the vehicle information storage portion 63 selects vehicle information entries 14 and 15 acquired in response to the second event and the vehicle information entries 23 and 24 acquired in response to the third event based on the event priority. The second event has the same priority as the third priority. Then, the vehicle information storage portion 63 selects, based on the occurrence order setting information, the vehicle information entries 14 and 15 acquired in response to the second event. As described above, the second event occurs prior to the third event.

Since the vehicle information entries 14 and 15 have two-entry data size and the minimum information amount is defined as two entries, the vehicle information storage portion 63 selects the vehicle information entries 23 and 24 acquired in response to the third event as the select information. Similarly, since the vehicle information entries 23 and 24 also have two-entry data size and the minimum information amount is defined as two entries, the vehicle information storage portion 63 specifies vehicle information entries 3, 5, 7, and 9 acquired in response to the first event as the select information.

As shown by symbol D4, the vehicle information storage portion 63 generates the decimation information from the select information based on the free area setting information and the time series setting information. The vehicle information storage portion 63 generates the free area to have a memory size equal to a data size of two vehicle information entries. The generation of the free area is performed based on the free area setting information corresponding to the cumulative number of four. The vehicle information storage portion 63 generates the decimation information to include vehicle information entries 5 and 9 by decimating other vehicle information entries from the vehicle information entries 3, 5, 7, and 9 acquired in response to the first event. The generation of the decimation information is performed based on the time series setting information corresponding to the first event related to the cumulative number of four shown in FIG. 6. As shown by symbol D5, the vehicle information storage portion 63 newly stores the decimation information as the time series information in the already written area, and generates the free area that has two-entry memory size.

As shown by symbol D6, the ECU 10 generates the storage information from the vehicle information entries 28 to 35 based on the time series setting information. The ECU 10 generates the storage information to include the vehicle information entries 28 and 29 by decimating other vehicle information entries from the vehicle information entries 28 to 35 acquired in response to the fourth event. The generation of the decimation information is performed based on the time series setting information corresponding to the fourth event related to the cumulative number of four shown in FIG. 6. Then, the ECU 10 stores the storage information in the free area.

In the information storage portion 541, the time series information that is newly acquired is stored in addition to three pieces of time series information, and the memory area does not remain. The four pieces of time series information include one piece of time series information that has vehicle information entries 5 and 9 acquired in response to the first event, one piece of time series information that has vehicle information entries 14 and 15 acquired in response to the second event, one piece of time series information that has vehicle information entries 23 and 24 acquired in response to the third event, and one piece of time series information that has vehicle information entries 28 and 29 acquired in response to the fourth event.

With this configuration, in the information storage portion 541 of the EEPROM 54, the ECU 10 stores multiple pieces of time series information that have been stored by now, and the memory area does not remain. Thus, when the cumulative number is less than the cumulative upper limit, the amount of the time series information can be greater than the minimum information amount.

Figure 11:
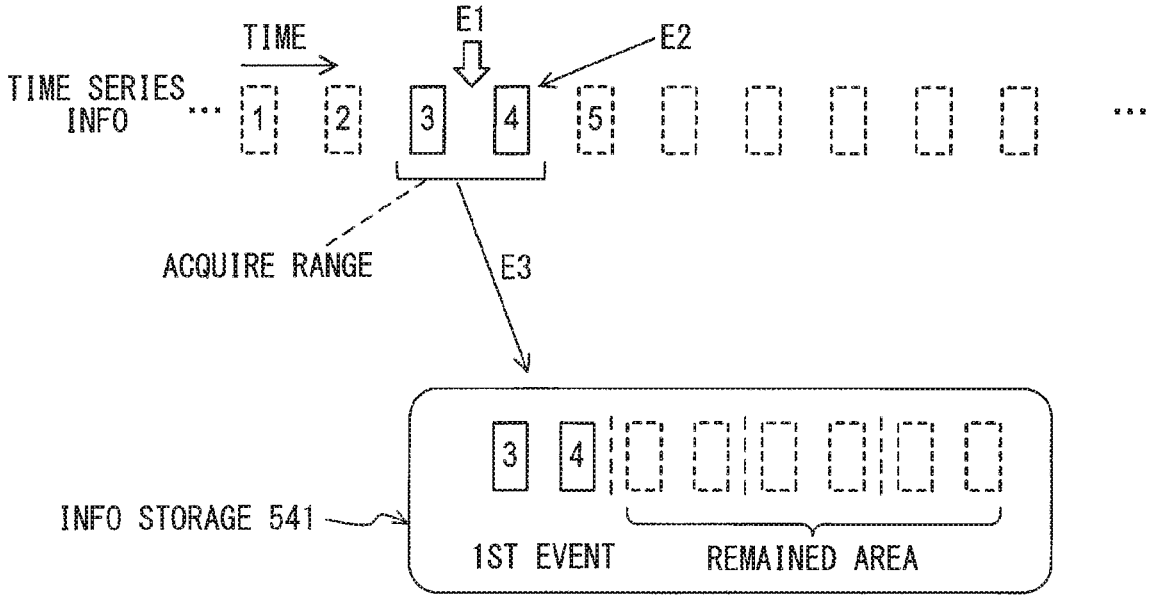
FIG. 11 is a diagram showing an operation of ECU as a comparison example.

Conventional operation of ECU will be shown in FIG. 11 as a comparison example. As shown by symbol E1, suppose that the first event occurs. As shown by symbol E2, the ECU in the comparison example may store the time series information that has a predetermined minimum information amount, such as two entries in the RAM. As shown by symbol E3, the ECU stores the time series information that has the predetermined minimum information amount in the information storage portion 541. Thus, in the information storage portion 541, there is six-entry memory areas are remained without being used.

When the cumulative number is less than the cumulative upper limit, the ECU 10 of the present embodiment can store more detailed time series information than the ECU described in the comparison example shown in FIG. 11.

(Advantages)

The embodiment described above can provide advantages below.

The ECU 10, in S10, acquires the event information that represents the occurrence of predetermined event related to the vehicle. The ECU 10, in S15, acquires the cumulative number of the event occurrence each time the ECU 10 acquires the event information. The ECU 10, in S25, acquires the time series information each time the ECU 10 acquires the event information.

The ECU 10, in S65, stores at least one piece of the time series information that is newly acquired in S25 using all area of the information storage portion 541 corresponding to the cumulative number each time the ECU 10 newly acquires the time series information. Herein, the memory area of the information storage portion 541 has the predetermined amount. The time series information includes the vehicle information entries each of which represents the predetermined vehicle condition and is arranged in chronological order.

With the above-described configuration, the ECU 10 can store the time series information that is newly acquired using all area of the information storage portion 541 corresponding to the cumulative number. Thus, the ECU 10 can efficiently use the memory area in the information storage portion 541 and the memory area does not remain.

When the cumulative number is one, the ECU 10, in S45, stores the time series information that is acquired in S25 in all area of the information storage portion 541.

With this configuration, even when the cumulative number is one, the ECU can efficiently use all of the memory area in the information storage portion 541 and the memory area does not remain.

When the cumulative number is equal to or more than two, the ECU 10, in S50, selects a piece of the time series information stored in the information storage portion 541. The ECU 10, in S55, acquires the select information that is specified in S50. The ECU 10, in S60, (i) generates the decimation information to include at least one entry of the vehicle information that is decimated from the select information, (ii) newly stores the decimation information as the new time series information in the already written area of the information storage portion 541 where the select information is stored, and (iii) generates the free area where remaining information other than the decimation information is stored in the already written area. The ECU 10, in S35, generates the storage information that has the information amount corresponding to the free area from the time series information newly acquired in S25. The ECU 10, in S65, stores the generated storage information in the free area.

With the above-described configuration, when the cumulative number is equal to or more than two, the ECU 10 (i) generates the free area by newly storing the decimation information, which is generated from the time series information, again in the area in which the time series information has been stored, and (ii) stores the time series information that is newly acquired in the free area. Thus, even when the cumulative number is equal to or more than two, multiple pieces of time series information can be stored using all area of the information storage portion 541. With this configuration, the ECU 10 can efficiently use the memory area of the information storage portion 541.

When specifying the select information, the ECU 10, in S50, selects one of multiple pieces of time series information stored in the information storage portion 541 corresponding to the priority of the event that triggers the acquisition of the time series information.

With the above-described configuration, the ECU 10 can select one piece of time series information acquired in response to the event that has the lowest priority from the multiple pieces of time series information stored in the information storage portion 541. In this case, the ECU 10 generates the decimation information based on the time series information that is acquired in response to the event having the lowest priority. That is, the time series information that is acquired in response to the event having the high priority, the information amount can be greater than the information amount of the time series information that is acquired in response to the event having the low priority.

The ECU 10, in S50, selects a piece of the time series information that has been stored in the information storage portion 541 corresponding to the occurrence order of the event that triggers the acquisition of the time series information. In the present embodiment, the time series information having the oldest occurrence order is prioritized when specifying the select information.

With the above-described configuration, when multiple pieces of time series information that are acquired in response to the events having the lowest priority are stored in the information storage portion 541, the ECU 10 can specify, as the select information, one piece of time series information that has the oldest occurrence order. Thus, only one piece of select information can be selected.

OTHER EMBODIMENTS

While the embodiment according to the present disclosure has been described above, the present disclosure is not limited to the above-described embodiment and is intended to cover various modifications.

(First Modification)

In the above-described embodiment, the type of the events which trigger the acquisition of the time series information is four. The type is not limited to four. The type of the events may be set to arbitrary number, such as two types, three types, five types, or more.

(Second Modification)

In the above-described embodiment, the cumulative upper limit is set to four. The cumulative upper limit is not limited to four. The cumulative upper limit may be set to an arbitrary number of equal to or more than two. Suppose that the cumulative upper limit is set to two, settings of the event priority and an occurrence priority, each of which is shown in FIG. 5 according to the above-described embodiment is not necessary.

(Third Modification)

In the above-described embodiment, the time series information acquired in S25 has eight entries of vehicle information. The memory area that has the same size as the information amount of the time series information is defined in the EEPROM 54 as the information storage portion 541. The memory area of the information storage portion 541 is not limited to have the size same as the information amount of the time series information. The information amount of the time series information acquired in S25 may be set to an arbitrary information amount that is equal to or more than the memory size of the information storage portion 541.

(Fourth Modification)

In the above-described embodiment, in the select processing executed in S50, the ECU 10 selects one piece of the time series information that has been already stored in the information storage portion 541 based on the priority of event that triggers the acquisition of the time series information and the occurrence order of the events. Process of the select processing is not limited to the configuration described above. The ECU 10, in the select processing executed in S50, may select one piece of the time series information that has been stored in the information storage portion 541 corresponding to only the occurrence order of the events.

The ECU 10 may specify, as the select information, one piece of time series information that is acquired in response to the event having the oldest occurrence order. The ECU 10 may specify, as the select information, one piece of time series information that is acquired in response to the event having the newest occurrence order. With this configuration also, one piece of time series information can be specified as the select information.

(Fifth Modification)

In the above-described embodiment, when the cumulative number is equal to or more than two, the ECU 10 generates the free area in the already written area, and stores the storage information in the free area. Process of generating the free area is not limited to the configuration described above. The ECU 10 may not have the configuration described above. The ECU 10 may be configured in different manner. For example, only when the cumulative number is one, the ECU 10 stores the time series information that is acquired in S25 to all area of the information storage portion 541.

(Sixth Modification)

Each portion can be divided into several sub-portions while several portions can be combined into a single portion. Furthermore, each of thus configured portions can be also referred to as a circuit, device, module, or means. While the disclosure has been described with reference to preferred embodiments thereof, it is to be understood that the disclosure is not limited to the preferred embodiments and constructions. The disclosure is intended to cover various modification and equivalent arrangements. In addition, the various combinations and configurations, which are preferred, other combinations and configurations, including more, less or only a single element, are also within the spirit and scope of the disclosure.

A piece of the event information corresponds to an event information item. A piece of the time series information corresponds to a time series information item. A piece of the vehicle information corresponds to a vehicle information item. A piece of the select information corresponds to a select information item. A piece of decimation information corresponds to a decimation information item.

(Seventh Modification)

The ECU 10, the microcomputer 50, the CPU 51, which are described above, and program that controls the CPU 51, a non-transitory tangible storage medium, such as a semiconductor memory, which stores the program, method for storing information, or the like may be achieved by the present disclosure.

The ECU 10 corresponds to an event portion, a cumulative number acquiring portion, a time series information acquiring portion, a storage information generation portion, an initial storing portion, selection portion, a select information acquiring portion, a free area generation portion, a storing execution portion, and a storage information storing portion.

Process executed in S10 corresponds to the event portion. Process executed in S15 corresponds to the cumulative number acquiring portion. Process executed in S25 corresponds to the time series information acquiring portion. Process executed in S35 corresponds to the storage information generation portion. Process executed in S45 corresponds to the initial storing portion. Process executed in S50 corresponds to the selection portion. Process executed in S55 corresponds to the select information acquiring portion. Process executed in S60 corresponds to the free area generation portion. Process executed in S65 corresponds to the storing execution portion and the storage information storing portion.

While the disclosure has been described with reference to preferred embodiments thereof, it is to be understood that the disclosure is not limited to the preferred embodiments and constructions. The disclosure is intended to cover various modification and equivalent arrangements. In addition, the various combinations and configurations, which are preferred, other combinations and configurations, including more, less or only a single element, are also within the spirit and scope of the disclosure.

What is claimed is:

1. An electronic control apparatus attached to a vehicle comprising:

an event portion configured to acquire an event information item representing an occurrence of an event that is predetermined and related to the vehicle;

a cumulative number acquiring portion configured to acquire a cumulative number of the occurrence of the event each time the event information item is acquired;

a time series information acquiring portion configured to acquire a time series information item each time the event information item is acquired; and a storing execution portion configured to store, in an information storage portion, one or more time series information items that has been cumulatively acquired, every time the time series information acquiring portion acquires the time series information item, wherein:

when storing the one or more time series information items, the storing execution portion adjusts a data size of each of the one or more time series information items according to the cumulative number so that an overall data size of the one or more time series information items stored in each time matches with an entire storage area of the information storage portion, which is fixed in size;

the time series information item includes vehicle information entries arranged in chronological order; and each of the vehicle information entries represents a condition of the vehicle.

2. The electronic control apparatus according to claim 1, wherein the storing execution portion includes an initial storing portion configured to store the time series information item acquired by the time series information acquiring portion in the entire storage area of the information storage portion when the cumulative number is one.

3. The electronic control apparatus according to claim 1, wherein, the storing execution portion includes:

a selection portion configured to select one time series information item from the one or more time series information items when the cumulative number is equal to or more than two;

a select information acquiring portion configured to acquire, as a select information item, the one time series information item selected by the selection portion;

a free area generation portion configured to (i) generate a decimation information item from the select information item, (ii) store the decimation information item in a part of an already written area of the information storage portion, and (iii) generate a free area in the already written area, wherein the decimation information item is generated by decimating at least one of the vehicle information entries from the select information item, the already written area is defined as an area where the select information item is previously stored in the information storage portion, and the free area is a remaining area in the already written area of the information storage portion after the decimation information item is stored in the part of the already written area;

a storage information generation portion configured to generate a storage information item by adjusting a data size of a new time series information item newly acquired when the cumulative number is equal to or more than two so that a data size of the new time series information item matches with a size of the free area; and a storage information storing portion configured to store the storage information item in the free area.

4. The electronic control apparatus according to claim 3, wherein the event includes a plurality of sub events having respective predetermined types, a priority is previously set for each of the plurality of sub events, and the selection portion selects the one time series information item from the one or more time series information items based on the priority of each of the plurality of sub events which triggers an acquisition of corresponding one of the time series information item.

5. The electronic control apparatus according to claim 3, wherein the event includes a plurality of sub events having respective predetermined types, and the selection portion selects the one time series information item from the one or more time series information items based on an occurrence order of each of one of the plurality of sub events which triggers an acquisition of corresponding one of the time series information item.

* * * * *